United States Patent [19]

Thomas et al.

[11] Patent Number: 4,594,928

[45] Date of Patent: Jun. 17, 1986

[54] KNIFE CYLINDER FOR WORKING WEBLIKE MATERIAL

[75] Inventors: Hermann Thomas, Darmstadt; Josef Herd, Munster, both of Fed. Rep. of Germany

[73] Assignee: Maschinenfabrik Goebel GmbH, Fed. Rep. of Germany

[21] Appl. No.: 575,295

[22] Filed: Jan. 30, 1984

[30] Foreign Application Priority Data

Feb. 3, 1983 [DE] Fed. Rep. of Germany ..... 3303628

[51] Int. Cl.[4] ..... B26D 1/00

[52] U.S. Cl. ..... 83/698; 144/218; 144/230; 407/43; 409/217

[58] Field of Search ..... 83/698, 700, 677; 144/230, 218, 172, 173, 174; 409/217, 234, 232; 407/43, 35, 49

[56] References Cited

U.S. PATENT DOCUMENTS 4,187,753 2/1980 Walde ..... 83/698 X
4,220,186 9/1980 Sybentz ..... 144/174 X
4,409,721 10/1983 Tomita et al. ..... 409/232 X

FOREIGN PATENT DOCUMENTS 1939358 6/1970 Fed. Rep. of Germany .
2244077 3/1974 Fed. Rep. of Germany .
2355290 5/1975 Fed. Rep. of Germany .
2446722 4/1976 Fed. Rep. of Germany .
3127722 2/1983 Fed. Rep. of Germany .

*Primary Examiner*—Douglas D. Watts

[57] ABSTRACT

An apparatus for rapidly changing a plurality of knives secured within a knife cylinder of a paper cutting or perforating machine includes a pressure generator for pressurizing a plurality of pressure cylinders which actuate a force transmission mechanism for bracing the knives securely within the knive cylinder. A pressure conduit system includes a device for admitting a pressure medium into the system and a device for bleeding the system. A biasing mechanism is provided to maintain pressure within the conduit system.

5 Claims, 4 Drawing Figures

KNIFE CYLINDER FOR WORKING WEBLIKE MATERIAL

BACKGROUND OF THE INVENTION

1. Field of the Invention

This invention concerns knife cylinders for cross-cutting or cross-perforating weblike material such as paper, plastic foil, metal foil or fabrics. The knife cylinders are formed with at least one groove for receiving a knife positioned essentially parallel to the axis of rotation of the cylinder and include pressure points distributed over the length of the knife for bracing the knife within the cylinder.

2. Description of the Prior Art

Knife cylinders of the type to which this invention is directed are used in machines for producing cuts in weblike materials. These cuts can be produced with knives having a discontinuous edge for producing a perforation or having a continuous edge for cutting off sheets of a particular length from an endless web. The cut lines in this instance usually run transverse to the direction of travel of the web, but they can also be positioned obliquely to the direction of travel of the web.

The knives are customarily set in a rotating knife cylinder such that knives which have become dull can be replaced without having to remove the entire cylinder from the working machine. At least one knife is fastened to each knife cylinder, although, several knives can be distributed over the circumference of the knife cylinder in order to obtain cuts which have a closer spacing to each other than that corresponding to the diameter of the knife cylinder.

For the knives to be able to function in the desired manner, they must be set in relation to the web to appropriately be worked or in relation to a pressure cylinder cooperating with the knife cylinder. The knives must therefore be fastened in a non-positive manner to the knife cylinders. The knives are customarily braced in relation to the knife cylinder with the aid of wedges such as disclosed in U.S. Pat. No. 4,187,753. Here, several screws are associated with each knife and are distributed over the length of the knife. However, even if only one single dull knife is to be replaced by a sharp knife, a plurality of screws must be loosened and then retightened. This replacement requires considerable time and thus considerably delays production during use of the working machine.

As an improvement, published German Pat. application DE-OS No. 2,355,290 discloses a rapid tensioning system which utilizes a wedge and cylindrical tension pieces. Several cylindrical tension rollers are associated with a knife, whereby the knife is braced against the knife cylinder by a reciprocal bracing of the rollers. The knife can be loosened along its entire length after only a single part has been loosened and can thus be rapidly removed from the machine. The knife can also be rapidly braced against a groove in the knife cylinder.

If several knives are distributed around the circumference of a knife cylinder, each knife must be set in relation to the associated pressure cylinder cooperating with the knife cylinder. This is generally accomplished by first pretensioning all knives with a relatively slight pressure. Then, the knife cylinder is run opposite the pressure cylinder while the web is passing therethrough, whereby the knives are shifted by minute amounts, generally in a radial direction. The knives are not tightened with full force until this adjustment is completed and must be initially fastened in a non-positive manner due to the necessary adjusting.

Since the knives should not shift when the machine is in operation, a large force is required to tighten the knives firmly in place. This force is so great that all machine parts associated with the tightening procedure can be deformed, at least over a period of time. For example, the device disclosed in the aforementioned DE-OS No. 2,355,290 is susceptible to such deformation.

The tension rollers of published German patent application DE-OS No. 2,355,290 are deformed due to the large force produced by the tensioning device. The tensioning device thus becomes loose during the operation of the knife cylinder due to its construction thereby causing it to undesireably shift. The loosened knife thus produces either an unesired cut or not cut at all, or the knife becomes dislodged during the operation of the machine.

Published German patent application DE-OS No. 1,939,358 discloses a device including a hydraulic pressure ensuring system for fastening printing forms on the printing cylinders of printing machines. The pressure generator associated with the system is fastened to the printing cylinder. However, the force required to tension printing forms is considerably less than that required to tension knives. Thus, the tensioning system of DE-OS No. 1,939,358 is ineffective for the tensioning of knives.

Published German Pat. application DE-OS No. 2,244,077 discloses a device for clamping machining tools in which the knives clamped in a knife driving shaft can also be tensioned hydraulically. In this instance, however, the knives are clamped under quite different conditions compared to that required for knife cylinders for working webs, e.g., for cross-cutting or cross-perforating. There is also a different geometry for tensioning the knives, which results in a different clamping force. This geometry is based on the different functions required of these knives.

SUMMARY OF THE INVENTION

It is therefore an object of the present invention to improve upon a knife cylinder for operating on weblike material. The knives can be evenly braced relative to the knife cylinder for easy and rapid loosening and tensioning in such manner that the tension does not undesireably weaken or decrease during operation of the knife cylinder. This general objective is attained by using several pressure medium cylinders distributed over the length of each knife which press the knife against the cylinder a pressure generator is attached to the cylinder, a transmission device is positioned between each pressure medium cylinder and the knife, a spring is located between the pressure generator and the cylinder, and a conduit system is located in the cylinder with which the pressure generator and each pressure medium cylinder communicate.

One embodiment of the invention provides fill openings in the conduit system for introducing a pressure medium and also provides outlet openings for removing undesired media in the conduit, e.g., air.

The invention allows for a bracing of the knife or knives of each knife cylinder sufficiently strongly relative to the knife cylinder with a non-positive connection such that the knives do not undesireably loosen during operation of the knife cylinder and thus during operation of an entire processing machine assembly associated with the knife cylinder. It is also possible to pretension the knives relatively weakly at first, so that the knife cylinder can run opposite the associated pressure cylinder in order to precisely adjust the knives. As a consequence of this reduced pretensioning force, the knives can shift slightly in a radial direction while the knife cylinder slowly revolves in order to assume their final desired position. It is also possible to rapidly loosen not only one but all knives in the knife cylinder by a single manipulation, so that all the knives may be replaced during a brief stop period of the processing machine which usually cooperates with the cross-perforating or cross-cutting device. Thus, only a brief production delay is brought about for the entire machine.

BRIEF DESCRIPTION OF THE DRAWINGS

The invention will now be described in more detail with reference to a non-limiting embodiment schematically shown in the drawings. This embodiment can be modified in various ways without departing from the scope of the invention established by its basic concept. In the present context non-essential machine parts are not shown in the drawings for the sake of greater clarity, as these parts are already sufficiently known.

Various other objects, features and attendant advantages of the present invention will be more fully appreciated as the same becomes better understood from the following detailed description when considered in conjunction with the accompanying drawings, in which like reference characters designate like or corresponding parts through the several views and wherein.

DETAILED DESCRIPTION OF THE PREFERRED EMBODIMENTS

Figure 1:
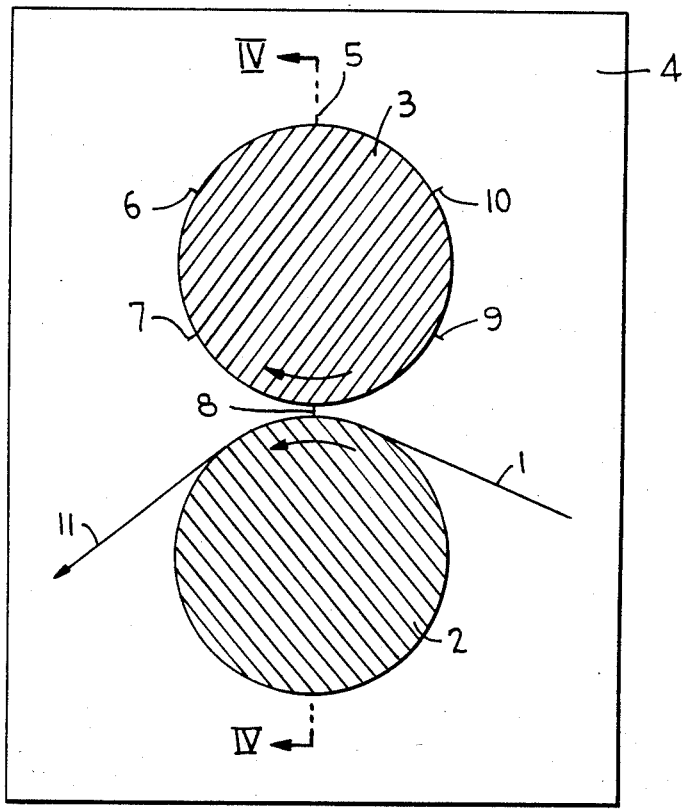
FIG. 1 is a schematic view of the perforating assembly, shown in partial section.

As shown in FIG. 1, a web 1 of paper, plastic, metal, foil, fabric or the like extends partially about a pressure cylinder 2, and is fed through a gap formed between pressure cylinder 2 and a knife cylinder 3. These cylinders are journalled in suitable bearings in a machine frame 4, and at least one of the cylinders is driven. However, both cylinders may be interconnected by gears, toothed belts or the like to effect synchronized rotation.

Cutting knives are located at positions 5, 6, 7, 8, 9 and 10 essentially in the direction of the central axis thereof 3 so as to lie parallel to or slightly inclined to this axis. The knives can have a continuous edge or an edge interrupted by transverse grooves. With have a continuous edge, web 1 is transversely cut into single sheets during its passage through the roller slot nip formed by cylinders 2 and 3. These sheets are delivered outwardly of the apparatus of FIG. I in the direction of arrow 11 and can be collected in a box, a drop area or the like.

If the knife edges are interrupted by transverse grooves, web 1 will of course not be completely severed transversely but will be perforated with cuts having connecting ties therebetween to facilitate separation into sheets along the perforations. Otherwise, bend lines rather than cuts may be introduced into the web at positions 5 to 10 to facilitate a zigzag folding of the web.

Cylinder 2 is provided with grooves 12, 13, 14, 15, 16 and 17 (FIG. 2) extending over the entire working width thereof. Six of such grooves, equally spaced, are shown although the knife cylinder may have only a single groove or fewer than six, e.g., four grooves. Thus, since one knife is located in each groove, the number of knives which work on web 1 varies according to the number of grooves. Alternatively knives may be omitted from one or more grooves, if desired.

Cylinder 3 likewise has bores 18, 19, 20, 21, 22 and 23 lying parallel to their associated grooves 12 to 17 and extending over the entire working width of knife cylinder 3. A pin 24 is fixed within each bore and forms a fulcrum for a lever 25 having a pair of lever arms 26 and 27. One side of lever 25 is curved as at 28 to form a cam. And, the knife cylinder has an enlarged cutout portion 29 associated with at least groove 12, lever 25 extending into portion 29 as well as into groove 12 and being pivotable about pin 24 therein.

A radially extending pressure cylinder 30 is threadeably mounted in cylinder 3 as at 32 in alignment with lever 25, the cylinder having a piston 31 capable of being extended by means of a pressure medium leading to the piston through a passageway 35.

A knife is located in groove 12, the edge of the knife being continuous or interrupted. At least one shim 34 is positioned between knife 33 and lever 25. Shim 34 can be as long as knife 33 and can be formed of steel, copper or plastic. Instead of a relatively wide shim 34 as shown, several narrower shims formed of different materials may be disposed between knife 33 and lever 25. In this manner the force transmitted through piston 31 to lever 25 and ultimately to the knife in of groove 12 is distributed over an axial area of knife 33 which is greater than the width of lever 25.

Lever arms 26 and 27 of lever 25 are of different lengths, such that, for example, lever 26 is five times longer than lever 25. In this manner the force produced by piston 31 is multiplied before it acts on knife 33. In the embodiment given, the force is quintipled as a result of the lever arm ratios present. The degree of force amplification can also be less, e.g., fourfold, threefold or only twofold.

Figure 3:
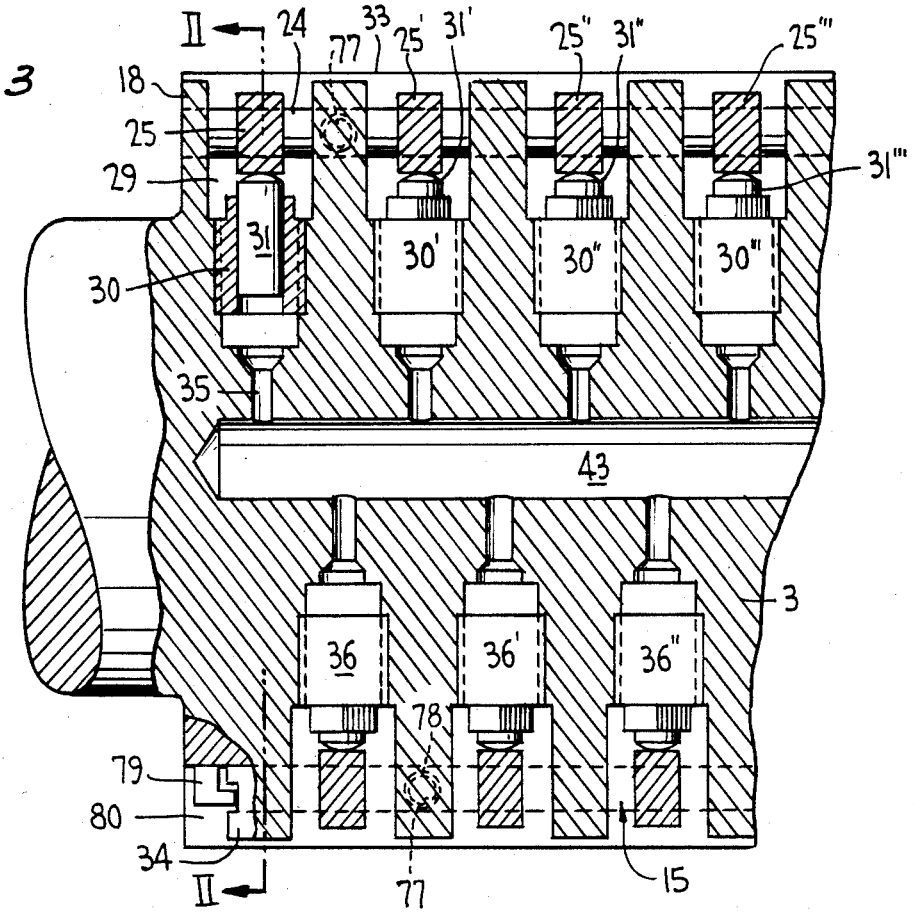
FIG. 3 is a section through the knife cylinder taken along line III—III in FIG. 2.

As shown in FIG. 3, pressure cylinders 30', 30'', 30''', etc. are respectively associated with levers 25', 25'', 25''', etc. which are arranged and function in the same manner as aforedescribed with reference to cylinder 30 and lever 25. These pressure cylinders and levers are distributed at regular intervals over the entire length of each knife. In such manner knife 33 can be secured in a non-positive manner in groove 12.

This non-positive connection is necessary since knife 33 must be adjusted to the thickness of web 1 and to the distance of knife cylinder 3 from the surface of pressure cylinder 2. This adjustment is normally carried out by securing knives 33 relatively weakly in their grooves and then rotating cylinders 2, 3. This causes the edges of the knives in the knife cylinder to contact web 1 or the surface of pressure cylinder 2. As a result of the weak securing force by which the knife or knives are held in knife cylinder 3, the knives can shift slightly outwardly in a radial direction toward the opposed surface of pressure cylinder 2 during cylinder rotation, thus obtaining the alignment necessary for the cutting or perforating operation.

This knife adjustment is carried out at a fairly low speed of rotation. At the end of this operation, the machine is stopped so that the knives may be tightened in their correct final adjusted positions. A large tightening force is then applied to secure knife 33 within cylinder 3 for the next work operation, which is carried out a considerably increased speed of rotation than during the adjusting and aligning operation.

Knife 33 disposed within groove 12 is associated with several fastening or securing devices in the form of pressure cylinders 30, 30', 30'', etc. and pistons 31, 31', 31'', etc. Another knife can be inserted into groove 15 in a corresponding manner and secured by corresponding pressure cylinders 36 in a corresponding manner. Several pressure cylinders 36, 36', 36'', etc. may be distributed over the entire width of the knife for securing same. As shown in FIG. 3, pressure cylinders 36 are located in a different plane than pressure cylinders 30 provided for knife 33. This is effected both for reasons of space and to avoid weakening of knife cylinder 3.

Figure 2:
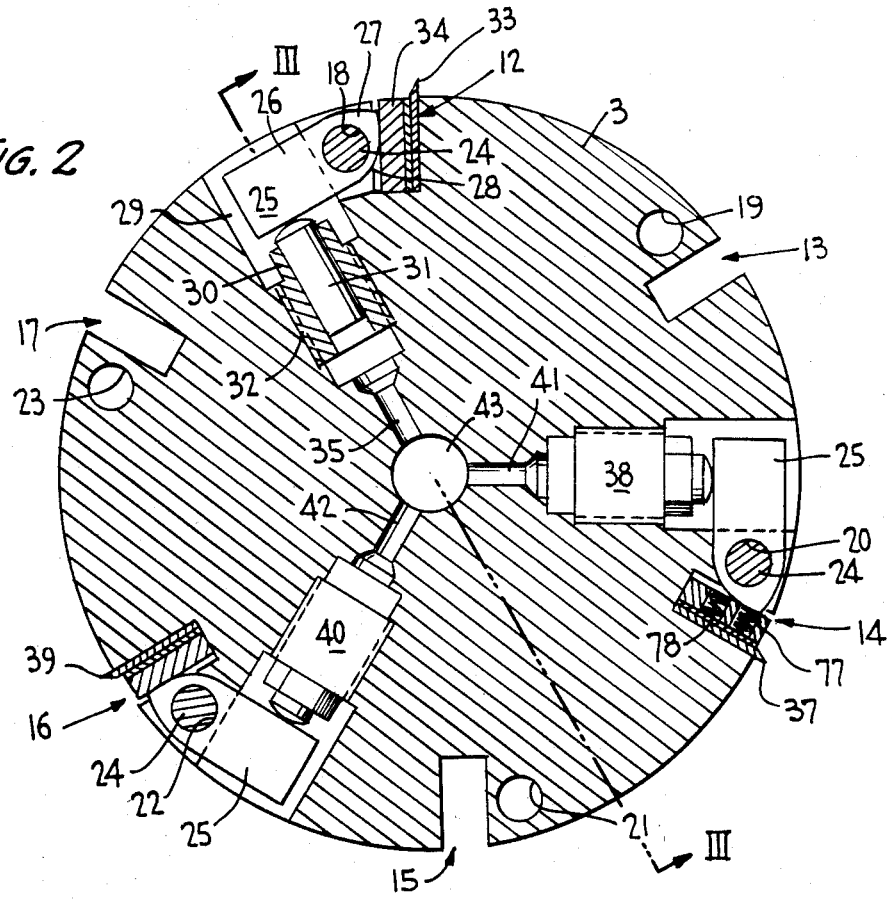
FIG. 2 is a sectional view of the knife cylinder taken along line II—II in FIG. 3.

Groove 14 shown in FIG. 2 is associated in a corresponding manner with knife 37 and with pressure cylinder 38, and groove 16 with knife 39 with pressure cylinder 40. Grooves 13 and 17 are provided in a corresponding manner with knives and pressure cylinders.

As seen in FIG. 2 pressure cylinders 30, 38 and 40 lie in a common plane, while the pressure cylinders associated with grooves 13, 15 and 17, e.g., pressure cylinders 36, lie in a different plane.

Borehole or passageway 35 as boreholes 41 and 42 a forms a part of a conduit system located within the interior of knife cylinder 3. Each pressure cylinder, e.g., pressure cylinders 30, 30', 30'', 30''', 36, 36', 36'', 36''', 38, (38', 38'', not shown), 40, (40', 40'', not shown), is associated with a borehole of this type which extends essentially radially within knife cylinder 3. All these boreholes communicate with a common conduit 43 which is preferably located in the center of knife cylinder 3. Conduit 43 extends over the entire working width of knife cylinder 3 as well as over at least one of the two axle journals of knife cylinder 3.

Figure 4:
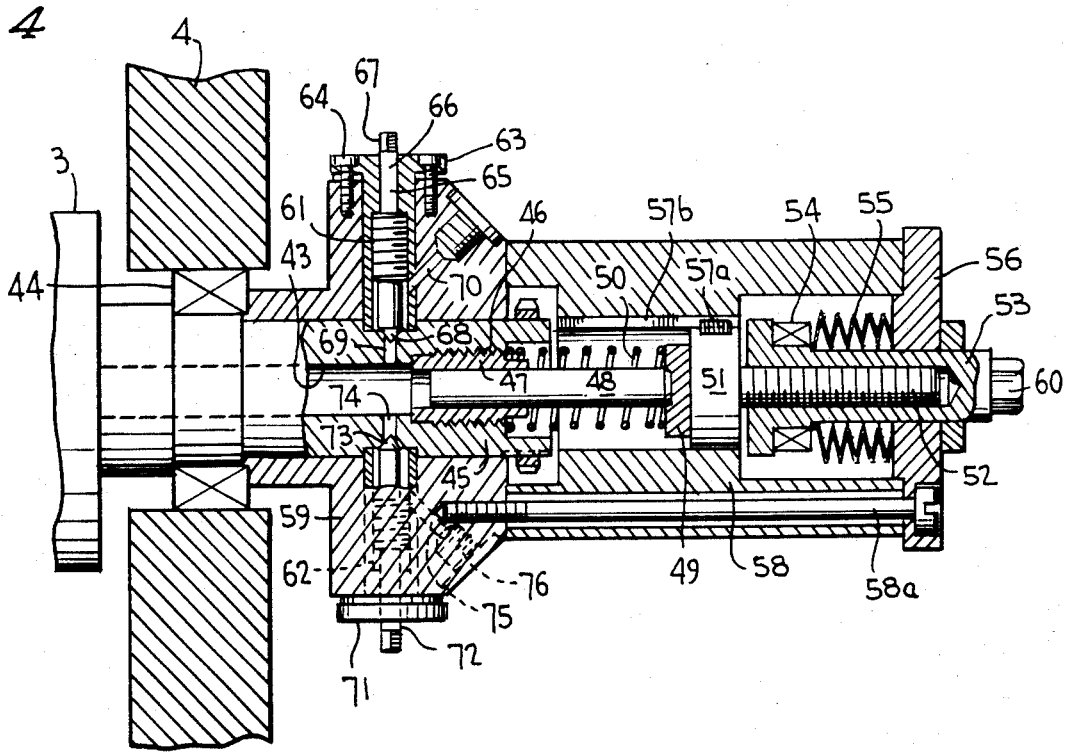
FIG. 4 is a section through a part of a pressure medium generating assembly for the knife blades of the knife cylinder.

As shown in FIG. 4, knife cylinder 3 is rotatably supported in side wall 4 by journal bearing 44. A bearing journal 45 has a threaded borehole 46 for the reception of a pressure cylinder 47 which comprises a pressure generator. A piston 48 extends into cylinder 47 and bears against a disk 49 which in turn bears against another piston 51 under the action of a return spring 50. An externally threaded pin 52 is formed integrally with and extends from piston 51. A casing 53 is threaded onto threaded pin 52 and is supported against a cover 56 with the interposition of axial bearing 54 and a packet of an disk springs belleville springs 55.

Piston 51 is guided by a feather key 57*a*, or the like, and a corresponding groove 57*b* located in a bush 58. Cover 56, bush 58 and another bush 59 are threadably interconnected by several screws 58*a* to form a unified housing, the screws being distributed around the circumference of preferably round bush 58 at regular intervals.

Casing 53 is provided with a hexagonal nut 60, by which, e.g., by applying a wrench, casing 53 can be rotated from the outside. When casing 53 is thus rotated, threaded pin 52 shifts axially due to the threaded connection, to correspondingly shift piston 51 connected thereto and piston 48 of pressure medium cylinder 47 as well, against the bias of spring 50.

Bush 59 contains at least two radially extending boreholes 61 and 62. Bush 63 extends into borehole 61 and is rigidly connected to bush 59 by screws 64. Bush 63 is provided with a partially threaded borehole 65 for the reception of a spindle 66 which extends outwardly of bush 63 and has a square outer end 67. The inner end of spindle 66 has a cone 68 forming a valve needle which is engageable with a corresponding countercone of borehole 69. Borehole 69 extends radially in bearing journal 45 and communicates with conduit 43.

An obliquely extending borehole 70 is located in bush 59 and also in bush 63, borehole 70 being internally threaded at its outer end for the reception of a pressure indicator and/or a conduit for pressure medium to be introduced into the conduit system which communicates with conduit 43 at this point.

A bush 71 is inserted into borehole 62 in a corresponding manner. Spindle 72 can be rotated in bush 71 so as to shift in a radial direction. Cone 73 of spindle 72 is connected to another radial borehole 74 and conduit 43. Borehole 75, which extends obliquely, is internally threaded at 76 76 at its outer end to facilitate connection of a run-off line, a vacuum pump or the like.

Supplementary boreholes 77, shown in FIG. 2 are located in the shims for the knives, e.g., in shim 34. A pressure spring 78 is set into each borehole 77. Thus, each knife can be held with little force in its associated groove with the aid of pressure spring 78, so that it is possible to rotate knife cylinder 3 for inserting another knife without the knife which was inserted first falling out of its groove.

If spindle 66 is shifted radially outwardly by rotation, a pressure medium, e.g., hydraulic fluid, can be added through opening 70 into the conduit system formed by boreholes 69, 74, conduit 43 and boreholes 41, 42 and 35, etc. This is particularly possible if a vacuum line is connected to threading 76. This makes its easy to remove or bleed air or other media from the conduit system, so that the pressure medium can reach all points of the conduit system.

When sufficient pressure medium is added to the conduit system, spindles 66 and 72 are shifted radially inwardly by rotation and the cones of the two spindles seal the conduit system against the outside environment. Then, hexagonal nut 60 is rotated for shifting piston 48 in FIG. 4 to to the left, which causes pressure to be created in the pressure medium and applied to the conduit system. This pressure presses the pistons of pressure cylinders 40, 38 and 30, etc. radially outwardly so as to pivot the associated levers 25. This causes nives 33 set in the grooves to be braced and held fast inside the grooves against a side wall of their associated groove. If hexagonal nut 60 is rotated by a relatively small amount, a relatively low clamping pressure is created on the knives which allows the knives to still be shifted slightly for the adjusting procedure relative to opposing pressure cylinder 12.

After pressure cylinder 2 and knife cylinder 3 have rotated a few times, it can be assumed that all knives have reached their final position. Then, hexagonal nut 60 can be rotated by a relatively large amount, which can be read on a scale or the like. The increasing rotation of hexagonal nut 60 produces a greater and greater pressure in the pressure medium added into the conduit system, which finally becomes so great that the knives are satisfactorily held in their grooves.

As a result of the mode of construction which is especially apparent in FIG. 4, piston 48 can be displaced not only by rotating casing 53 but also by expanding disk belleville springs 55, which are lined up one behind the other to form a packet or column of springs. Thus, there are two possibilities for creating pressure in the pressure medium added into the conduit system. The disk springs assure a preservation of the pressure in the pressure medium in an area delimited by their construction. For example, if slight amounts of pressure medium should escape from the conduit system due to leakage, the springs will maintain the necessary pressure. This prevents the knife or knives from loosening in an undesired manner while knife cylinder 3 is rotating.

All cylinders and thus all knives can be simultaneously tensioned or loosened on the basis of the central rotation of hexagonal nut 60. This means that all the knives can be rapidly replaced by sharp knives when the knives previously used become dull. Thus, it is no longer necessary to loosen the fastening screws for the individual knives which were used almost exclusively up to the present, which meant that a plurality of screws had to be loosened and then retightened for each knife. The screw construction which was used almost exclusively up to the present required the machine to be stopped for quite a while in order to replace dull knives with unused, sharp knives. In contrast to such prior constructions, this invention allows one to loosen or retension all knives simultaneously with a single adjustment, which decrease the down time of the entire machine required for exchanging the knives. The more knives there are in the knife cylinder, the greater the time savings. This advantage is made even greater by the fact that cross-cutting or cross-perforating devices usually cooperate with other processing machines which can operate only if the cross-cutting or cross-perforating apparatus is running.

It is advantageous, in order to be able to insert the various knives, if the shims associated with the knife are held on the knife cylinder in a radial direction. To this end, hooks 79 shown in FIG. 3 are provided on the two front ends of each shim which engage in corresponding openings cut in the shims. The hooks can be screwed onto knife cylinder 3 at position 80.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A knife cylinder for working weblike material, said cylinder being mounted on a frame for rotation about its axis of rotation, and comprising:

a cylindrical surface portion having at least one groove formed therein for receiving and positioning at least one knife substantially parallel to said axis of rotation;

a plurality of pressure medium cylinders distributed over the length of said knife for pressing said knife against said knife cylinder;

a pressure medium generating assembly attached to said knife cylinder for rotation together therewith, said assembly including a pressure generator for pressurizing said pressure cylinders;

a force transmission device disposed between each one of said pressure cylinders and said knife;

said assembly further including spring means operatively associated with said pressure generator for maintaining a predetermined pressure within said pressure cylinders; and conduit means within said knife cylinder and communicating with said pressure generator for transmitting pressure medium from said pressure generator to each one of said pressure cylinders.

2. The knife cylinder of claim 1, wherein said assembly further includes means for introducing the pressure medium within said conduit means.

3. The knife cylinder of claim 2, wherein said means for introducing the pressure medium within said conduit means comprises at least one borehole formed within said pressure generating assembly.

4. The knife cylinder of claim 1, wherein said assembly includes means for removing fluid from said conduit means.

5. The knife cylinder of claim 1, wherein said at least one groove comprises a plurality of grooves spaced over said cylindrical surface portion and each for receiving and positioning a knife.

* * * * *